US005725036A

United States Patent [19]

Walter

[11] Patent Number: 5,725,036

[45] Date of Patent: Mar. 10, 1998

[54] PLUNGE ROUTER WITH PRECISION ADJUSTMENT MECHANISM AND CONVERSION KIT

[76] Inventor: Daniel L. Walter, 510 Center St., Chardon, Ohio 44024

[21] Appl. No.: 801,195

[22] Filed: Feb. 18, 1997

Related U.S. Application Data

[63] Continuation of Ser. No. 652,096, May 23, 1996, abandoned.

[51] Int. Cl.[6] ..... B27C 5/00

[52] U.S. Cl. ..... 144/135.2; 144/154.5; 144/371; 409/182

[58] Field of Search ..... 144/134.1, 136.95, 144/135.2, 154.5, 371; 409/179, 180, 181, 182

[56] References Cited

U.S. PATENT DOCUMENTS

| | | | |
|---|---|---|---|
| 1,509,387 | 9/1924 | Witt | 144/135.2 |
| 2,353,202 | 7/1944 | Tautz | 144/135.2 |
| 4,537,234 | 8/1985 | Onsrud | 144/135.2 |
| 4,919,176 | 4/1990 | Gachet et al. . | |
| 5,094,575 | 3/1992 | Kieser et al. | 144/154.5 |
| 5,139,061 | 8/1992 | Nielson | 409/182 |
| 5,146,965 | 9/1992 | Gibson . | |
| 5,191,921 | 3/1993 | McCurry | 409/182 |
| 5,222,842 | 6/1993 | Schweikert et al. . | |
| 5,297,905 | 3/1994 | Schmidt et al. . | |
| 5,375,636 | 12/1994 | Bosten et al. . | |

OTHER PUBLICATIONS

Bosch Power Tools product guide, 1995, pp. 70–71.

Eagle America woodworking master catalog #61A, 1996, p. 11.

*Primary Examiner*—W. Donald Bray

*Attorney, Agent, or Firm*—Watts Hoffmann Fisher & Heinke

[57] ABSTRACT

A plunge router constructed for mounting beneath a work table has a base adapted to be connected to a work table and defining a central opening, a router head assembly comprising a drive motor, a drive shaft, a collet and a housing, a plunge guide assembly supporting the router head assembly for movement toward and away from the base, a retracted position adjusting mechanism coacting between the base and the head assembly for blocking movement of the head assembly to a first default position from a second, adjusted retracted position and comprising a threaded force transmitting member fixed to the base and projecting toward the head assembly, an abutment element projecting from the head assembly transverse to the direction of extent of the threaded member and an adjustment member threaded to the force transmitting member and engagable with the abutment element to adjustably change the head assembly second retracted position. The head assembly also includes a second head assembly abutment element. The plunge router of the present invention further comprises a precision adjustment mechanism for moving the head assembly a precise distance from the second position to precisely position a router bit relative to the base opening. The adjustment mechanism comprises a first positioner fixed to the base and extending to the second abutment element, a second positioner engaging the second abutment element and the first positioner and a drive transmission coupling the first and second positioners. The drive transmission operates to shift the second positioner along the first positioner to change the distance between the base and the second abutment element. The second positioner comprises a manually actuatable structure disposed remote from the second abutment element and operating the drive transmission to incrementally shift the head assembly for precisely positioning a router bit.

14 Claims, 3 Drawing Sheets

PLUNGE ROUTER WITH PRECISION ADJUSTMENT MECHANISM AND CONVERSION KIT

This application is a continuation of application Ser. No. 08/652,096, filed May 23, 1996, now abandoned.

FIELD OF THE INVENTION

The present invention relates to plunge routers and more particularly to plunge routers affixed to the underside of a worktable so that the router bit extends through an opening in the table to engage a work piece.

BACKGROUND OF THE INVENTION

Plunge routers are used in wood working to cut a variety of shapes into work pieces that form, for example, cabinets, panelling, moldings and furniture. Routers interchangeably accept router bits having a variety of shapes and sizes. Routers are constructed so that they can be used while hand held or when mounted to a work table or the like that is fixed with respect to the work piece. A "plunge" router is constructed to move the router bit toward and away from the work piece when the router is being hand held. The plunge router may be supported on the work piece with the bit retracted and moved to a desired position. When positioned, the router bit is advanced into the workpiece and the router moved to complete the routing operation. Movement toward the work piece is accomplished by an operator gripping router head assembly handles and exerting force to advance the router bit into contact with the work piece. The head assembly is biased to retract the router bit away from the workpiece when the handles are released. The fully retracted position is referred to as the "default" position. Plunge routers typically include a plunge adjustment mechanism that enables the operator to preselect the distance the router bit advances in the direction of the work piece to thereby determine the cut depth. A retracted position adjustment mechanism enables the operator to preselect and adjust the distance the router bit is retracted from the workpiece. For instance, if a number of shallow cuts is being made, the retracted position is adjusted so the bit just clears the work piece, thus minimizing operator effort required for advancing the bit.

Plunge routers may be detachably connected to the underside of a work table with the router bit projecting a fixed distance through an opening in the table. The work piece is propelled across the opening in engagement with the router. In this arrangement, the router bit is not manually advanced toward, or retracted from, the work piece. Conventionally, the extent to which the router bit projects through the work table opening is fixed by adjusting the retracted position adjustment mechanism.

THE PRIOR ART

Mounting a plunge router beneath a work table creates an unwieldy situation for making fine router bit height adjustments. The retracted position adjusting mechanism is not readily accessible in this arrangement. The operator must use a wrench to turn an adjustment nut below the table while attempting to determine the exact router bit height above the table top.

This situation has been improved by the use of fine adjustment accessories for some types of plunge routers. The fine adjustment accessory typically includes a threaded element carried by an extension arm having a handle at its end. The retracted position adjustment nut is replaced by the threaded element so that the extension arm and handle project from the router for easy access by the operator. The operator simply turns the handle to adjust the router bit height by operating the retracted position adjusting mechanism. Typical fine adjustment accessories for selected plunge routers are available from Eagle America as part numbers 400-0810 through 400-0818.

Some routers are so constructed and arranged that the fine adjustment accessory devices cannot be employed. For instance, a fine adjustment accessory that screws onto the retracted position adjusting mechanism cannot be used with Porter Cable plunge routers identified by model numbers 7538 and 7539. The router head assemblies interfere with, and preclude screwing the threaded element and extension arm onto the retracted position adjusting mechanism. Accordingly, when these routers are mounted beneath a work table, fine adjustment of the router bit position is cumbersome, difficult and time consuming.

The present invention provides a new and improved plunge router so constructed and arranged that precision adjustment of the router bit is accomplished easily and conveniently without requiring operation of the retracted position adjusting mechanism when the router is installed beneath a work table.

SUMMARY OF THE INVENTION

A plunge router constructed according to the present invention is adapted for free hand use or mounting beneath a work table top and comprises a mounting base, a router head assembly, a plunge guide assembly between the head assembly and the base for enabling the head assembly to shift relative to the base to advance and retract a router bit, a retracted position adjusting mechanism for limiting head assembly travel in a direction away from the base, and a precision adjustment mechanism for precisely positioning a router bit. The base is mounted beneath the table top and defines an opening through which a router bit moves to engage a work piece as the head assembly is shifted on the plunge guide assembly. The head assembly comprises a support housing, a drive motor, a drive shaft, and a collet. The drive shaft projects from the motor toward the base in alignment with the base opening. A router bit mounted in the collet can project through the opening for engaging a work piece.

The router head assembly is biased toward the default retracted position spaced away from the base a maximum extent. The retracted position adjusting mechanism coacts between the base and the head assembly for blocking head assembly movement to the retracted position from an adjusted retracted position. The retracted position adjusting mechanism comprises a threaded force transmitting member fixed to the base and projecting toward the head assembly, an abutment element projecting from the head assembly transverse to the direction of extent of the threaded member and an adjustment member threaded to the force transmitting member and engagable with the abutment element to adjustably change the head assembly second retracted position.

The precision adjustment mechanism moves the head assembly a precise distance from the second retracted position to precisely position a router bit mounted in the collet. The adjustment mechanism comprises a first positioner fixed to the base and extending to a second abutment element on the head assembly, a second positioner engaging the second abutment element and the first member and a drive transmission coupling the first and second positioners. The drive transmission shifts the second positioner along the first positioner to change the distance between the base and the second abutment. The second positioner comprises a manually actuatable structure, disposed remote from the second abutment, for operating the drive transmission to incrementally shift the head assembly for precisely positioning a router bit.

Further features and advantages of the invention will become apparent from the following detailed description of a preferred embodiment made with reference to the accompanying drawings.

DESCRIPTION OF THE BEST KNOWN MODE FOR PRACTICING THE INVENTION

Figure 1:
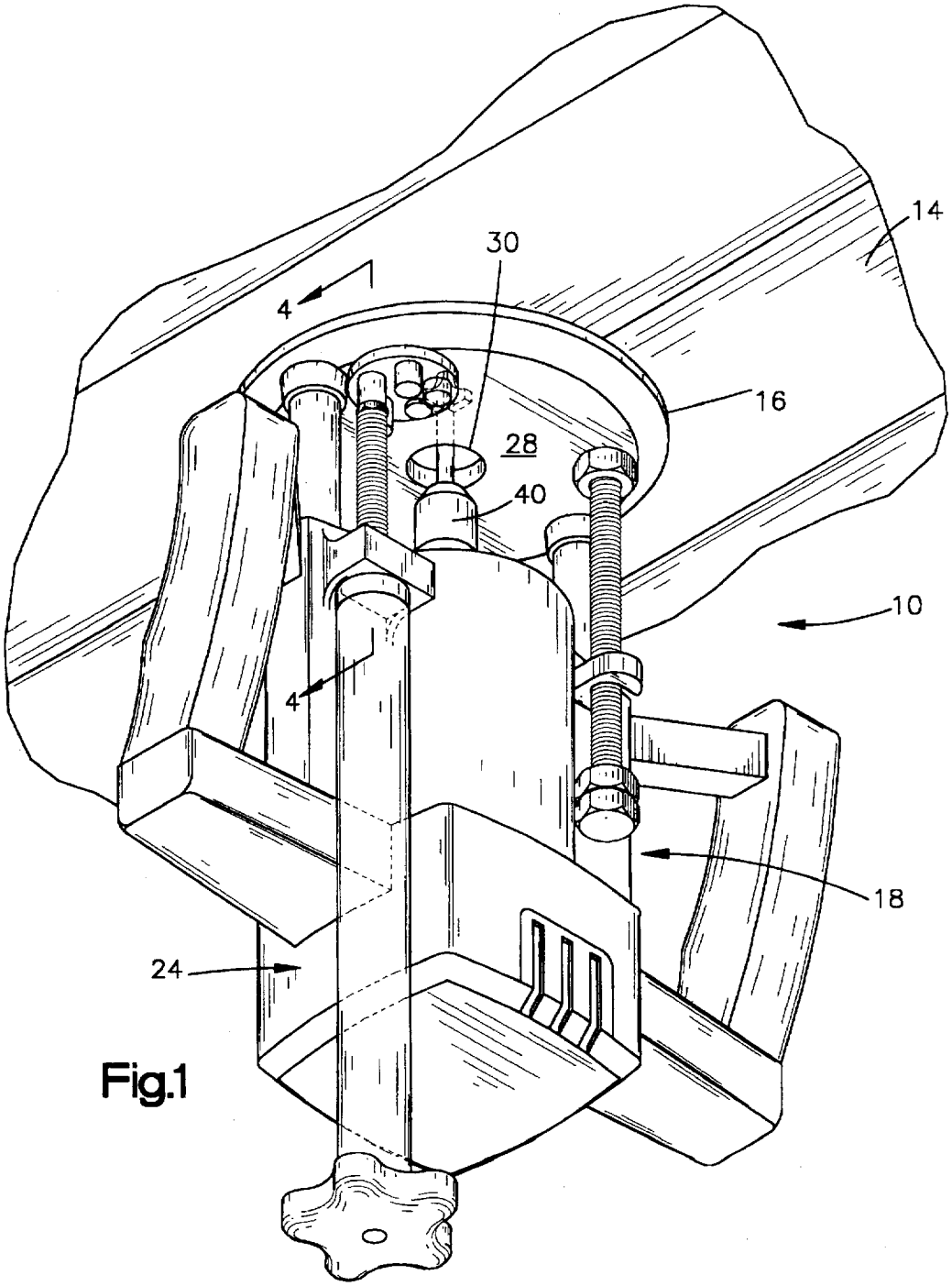
FIG. 1 is a perspective depiction of a plunge router with a precision adjustment mechanism for precisely positioning the router bit. The plunge router is attached to the underside of a work table with the router bit projecting through a hole in the table to the top of the table.
Figure 3:
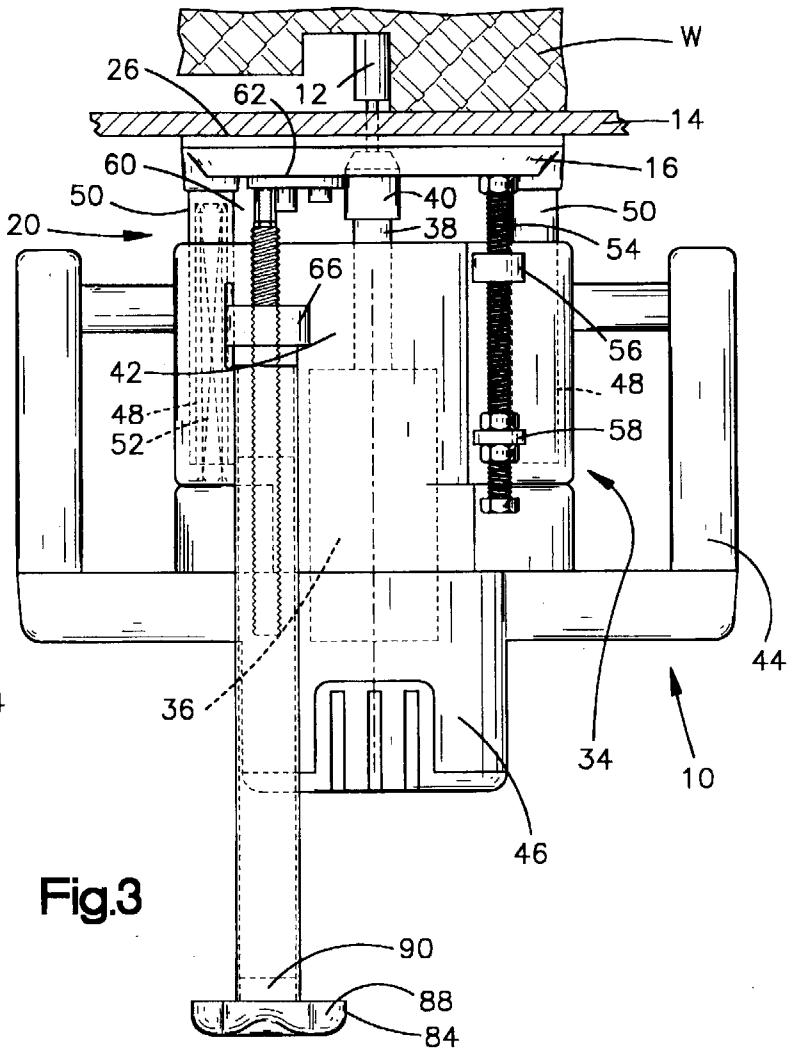
FIG. 3 is a front view of the plunge router of FIG. 2 depicting the router bit in a second, adjusted position.
Figure 2:
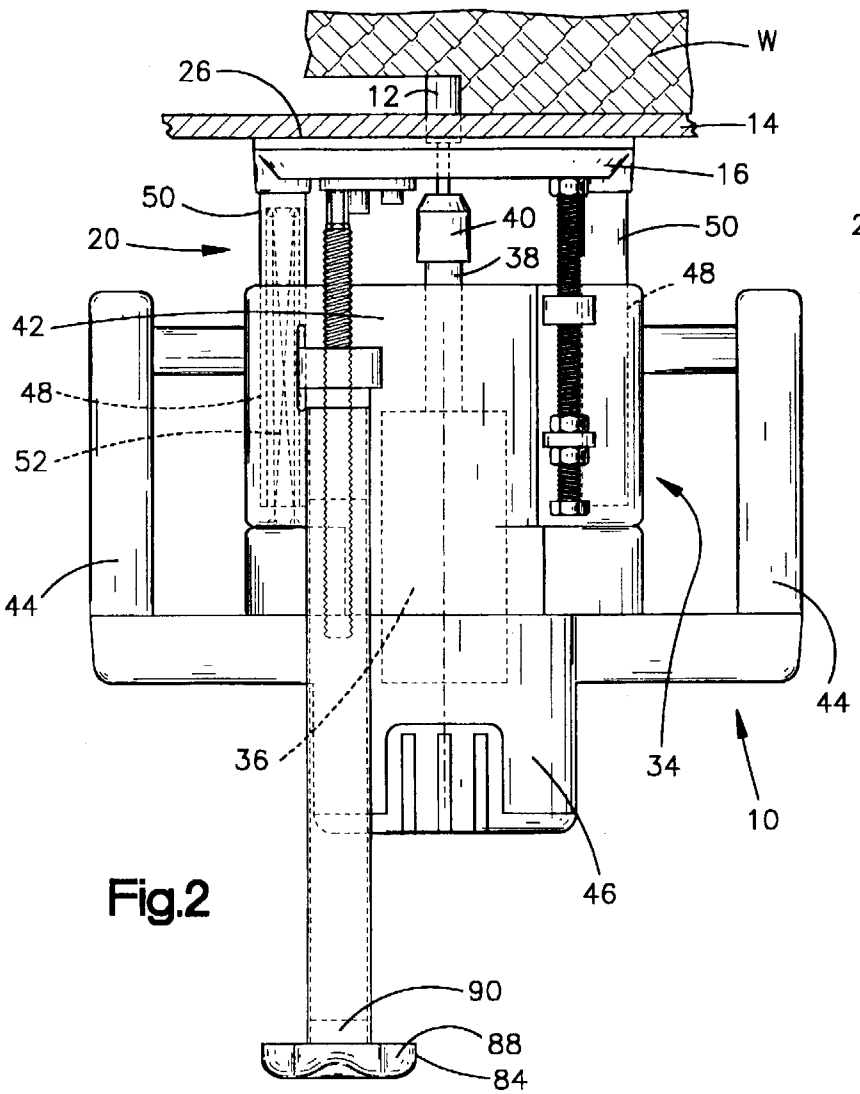
FIG. 2 is a front view of the plunge router of FIG. 1 depicting the router bit in a first adjusted position.

A plunge router 10 embodying the invention is illustrated in the drawings. The plunge router 10 is constructed for advancing and retracting a router bit 12 relative to a work piece W. The router 10 is illustrated as arranged for precisely positioning a router bit 12 to make precision depth cuts when the router is mounted under a work table 14 (See FIGS. 1–3). The plunge router 10 comprises a base 16 adapted for connection to the work table 14, a router head assembly 18, a plunge guide assembly 20 between the head assembly and the base for enabling the head assembly to advance and retract the router bit 12 relative to the base 16, a retracted position adjusting mechanism 22 for limiting head assembly travel in a direction away from the base 16, and a precision adjustment mechanism 24 for precisely positioning the router bit 12.

The base 16 is a generally annular member having a smooth flat supporting surface 26 facing away from the head assembly 18 and a central opening 30 through which the router bit 12 moves as it engages and is retracted from a work piece W. The base side 28 facing the head assembly 18 defines mounting bracket structures (not shown) for detachably securing the base 16 in position beneath the work table 14. The opening 30 is aligned with an opening 32 in the table top so the router bit 12 can project through the table opening 32 for cutting a work piece W on the table to a predetermined depth.

The head assembly 18 is manually shifted toward and away from the base 16 along the plunge guide assembly 20 so that the router bit 12 moves back and forth through the base opening 30. The head assembly 18 comprises a support housing 34, a drive motor 36 supported by the housing, a drive shaft 38 projecting from the motor and housing toward the base 16 and a router bit collet 40 secured to the shaft 38. When the router is operated as a plunge router, the operator grasps the head assembly 18 and manually controls the head assembly position and the motor operation. When the base 16 is attached beneath the table 14, the head assembly 18 is adjustably positioned with respect to the table 14 to control the router bit cutting depth in the work piece W atop the table.

The support housing 34 is supported for plunging motion on the plunge guide assembly 20 and maintains the motor 36 and drive shaft 38 firmly supported during cutting operations. The support housing 34 comprises a housing body 42 for receiving the motor 36 and drive shaft 38, manually graspable handles 44 projecting oppositely from opposite sides of the housing body 42 and a cover section 46 for closing the body 42. The body 42 and cover section 46 are detachably secured together to clamp the motor 36 between them. The body 42 and cover section 46 support bearings (not shown) for securing the motor armature (not shown) and drive shaft 38 in position. The body 42 also defines elongated tubular guide channels 48 for the plunge guide assembly 20 to facilitate head assembly motion relative to the base 16.

The drive motor 36 is a conventional ac motor (schematically shown) with a stator (not shown), armature (not shown), power line (not shown) and a manually operated on-off switch (not shown) located on one of the two handles 44. The drive shaft 38 is secured in the armature by bearings and projects toward the base 16. The collet 40 is fixed to an end of the shaft 38 and receives the router bit 12.

The plunge guide assembly 20 guides the head assembly motion as it sifts toward and away from the base 16. In the illustrated embodiment the guide assembly comprises two plunge guide members 50. The plunge guide members 50 are cylindrical in shape and each is attached at one end to the base 16. Each plunge guide member 50 extends into an associated guide channel 48 in the head assembly 18. The head assembly 18 is biased toward a default retracted position spaced away from the base 16 a maximum extent along the plunge guide members 50. In the preferred embodiment a spring 52, forming part of the plunge guide assembly 20, provides the head assembly biasing force.

The retracted position adjusting mechanism 22 coacts between the base 16 and the head assembly 18 for blocking movement of the head assembly 18 from a second, adjusted retracted position toward the default retracted position. The retracted position adjusting mechanism 22 comprises a threaded force transmitting member 54 fixed to the base 16 and projecting toward the head assembly 18, an abutment element 56 projecting from the head assembly 18 transverse to the direction of extent of the threaded member 54 and an adjustment element 58 threaded to the force transmitting member 54 for engaging the abutment element 56 to adjustably change the head assembly 18 retracted position. The adjustment element 58 comprises a pair of nuts threaded to the force transmitting member 54 so that they can be positioned as desired along the member 54 to adjust the retracted position.

When the router 10 is configured for plunge operation, a plunge limiting mechanism 60 assures that the router bit travel toward the work piece W is accurately limited. The plunge limiting mechanism 60 is only illustrated in part because the router 10 is shown configured for operating beneath the work table 14. The plunge limiting mechanism 60 comprises a turret supporting location 62 on the base 16, a stepped turret assembly 64 rotatably mounted on the base at the turret location 62, a lip structure 66 on the head assembly 18 aligned with the turret location 62, an adjustable stop rod (not shown) loosely extending through a hole in the lip structure 66 and a stop screw (not shown) threaded into the lip structure 66 for engaging and fixing the stop rod in position relative to the head assembly. The head assembly 18 is shifted toward the base 16 to advance the router bit 12 until the stop rod engages a step on the turret assembly 64 to limit the plunging motion. The rod is movable between adjusted positions relative to the turret assembly by loosening the stop screw, adjusting the rod position and retightening the stop screw.

The plunge travel is also adjustable by rotating the turret assembly 64 between selected positions so the rod travel is changed depending on which turret step is engaged by the stop rod. The illustrated turret assembly is a metallic cast element comprising several turret steps of different heights projecting away from the base. Turret step selection is made by rotating the assembly until the desired step is aligned with the hole in the lip structure 66. One or more steps defines a tapped opening formed by a nut embedded at the top of the step. A stop screw engageable by the stop rod is threaded through the nut. The screw reinforces the step during engagement with the stop rod.

The router 10 described to this point is commercially available as Porter Cable model nos. 7538 and 7539.

When the router 10 is mounted beneath the work table 14 plunge limiting mechanism is not used because the router bit 12 is not advanced toward and retracted from the work piece W. The illustrated router 10 is configured to operate under a work table 14 utilizing the precision adjustment mechanism 24 instead of the plunge limiting mechanism 60.

Figure 4:
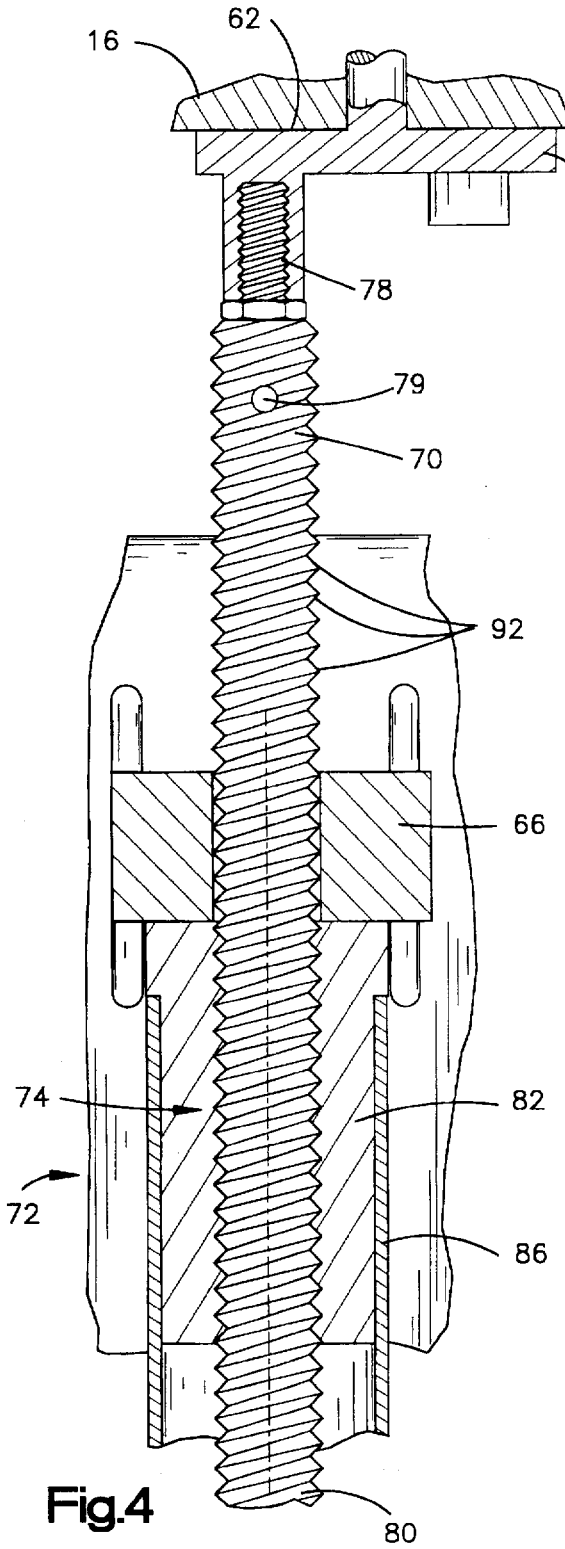
FIG. 4 is an enlarged cross sectional view seen approximately from the plane indicated by the line 4—4 of FIG. 1.

The router 10 of the preferred embodiment differs from the Porter Cable model nos. 7538/9 by incorporating the precision adjusting mechanism 24 in place of at least part of the plunge limiting mechanism referred to. The precision adjustment mechanism 24 moves the head assembly 18 a precise distance from the second, adjusted retracted position to precisely position a router bit 12 relative to the base opening 30 and work piece W. The adjustment mechanism 24 comprises a first positioner 70 fixed to the base 16 and extending to the lip structure 66, which in the modified router forms a second abutment element (indicated by the reference character 66), a second positioner 72 engaging the second abutment element 66 and the first positioner 70, and a drive transmission 74 coupling the first and second positioners. (See FIG. 4.)

The first positioner 70 moves relative to the second positioner 72 to shift the head assembly 18 relative to the base 16. The first positioner 70 comprises a rod having a first end 78 fixed to the turret location and a second end 80 projecting through the second abutment opening for engagement with the second positioner 72. The diametrical extent of the second end 80 is smaller than the diametrical extent of the second abutment opening so that the positioner end 80 is freely movable in the opening as the head assembly shifts toward or away from the base. In the preferred and illustrated router, the rod end 78 has a reduced diameter compared to the end 80, is threaded and is screwed into a tapped hole in a turret assembly step aligned with the second abutment opening. A transverse opening 79 in the positioner 70 above the threaded end 78 receives an allen wrench, or the like, to facilitate screwing the positioner 70 into the turret with a substantial amount of torque. While the positioner 70 is illustrated as threaded to the turret location, it could as well be fixed to the turret location by other suitable or conventional connectors.

The second positioner 72 projects away from the second abutment 66 to a manually accessible location to facilitate incremental router bit position adjustment. The positioner 72 comprises an abutment element 82 for engaging the second head assembly abutment element 66, a manually actuatable structure 84 remote from the element 82 and a linkage 86 extending between the element 82 and the structure 84. The linkage 86 is illustrated as a tubular cylindrical shaft having the element 82 fixed in one end and the structure 84 fixed in the remote opposite end. The shaft 86 is preferably formed from a relatively thick walled plastic tube. The illustrated abutment element 82 is formed by a generally cylindrical, tubular rigid metallic member surrounding the positioner 70 and having one end engagable with the abutment 66. The element 82 is illustrated as having a cylindrical body portion, received in the shaft 86, and a shouldered end projecting from and abuting the shaft end. The structure 84 is illustrated as a lobed hand wheel 88 and cylindrical axle 90. The axle 90 is fixed to the hand wheel and fixed in the shaft end.

The drive transmission 74 is manually operated to move the positioners 70, 72 relative to each other for incrementally repositioning the router bit 12. In the illustrated and preferred embodiment of the invention the transmission 74 is formed by interengaged threads formed on the positioners 70, 72. The positioner 70 carries external threads 92 extending from the end 80 to the section 78. The external threads 92 mesh with internal threads formed in the abutment element 82. As the hand wheel 88 is turned in one direction the abutment element 82 is rotated to advance the element 82 along the external threads 92 toward the base 16. The element 82 thus bears on the second abutment 66, forcing the head assembly toward the base 16 against the force of the spring 52 and moving the router bit 12 toward the work piece W. The degree of router bit movement is easily controlled because the thread pitch is low. When the hand wheel 88 is turned in the opposite direction the abutment element 82 is moved along the threads 92 toward the positioner end 80. The spring 52 urges the head assembly 18 away from the base toward the default position thus maintaining the second abutment 66 engaged with the abutment element 82 as the hand wheel is turned. Consequently the head assembly moves incrementally away from the base 16, retracting the router bit 12 from the work piece W.

Figure 5:
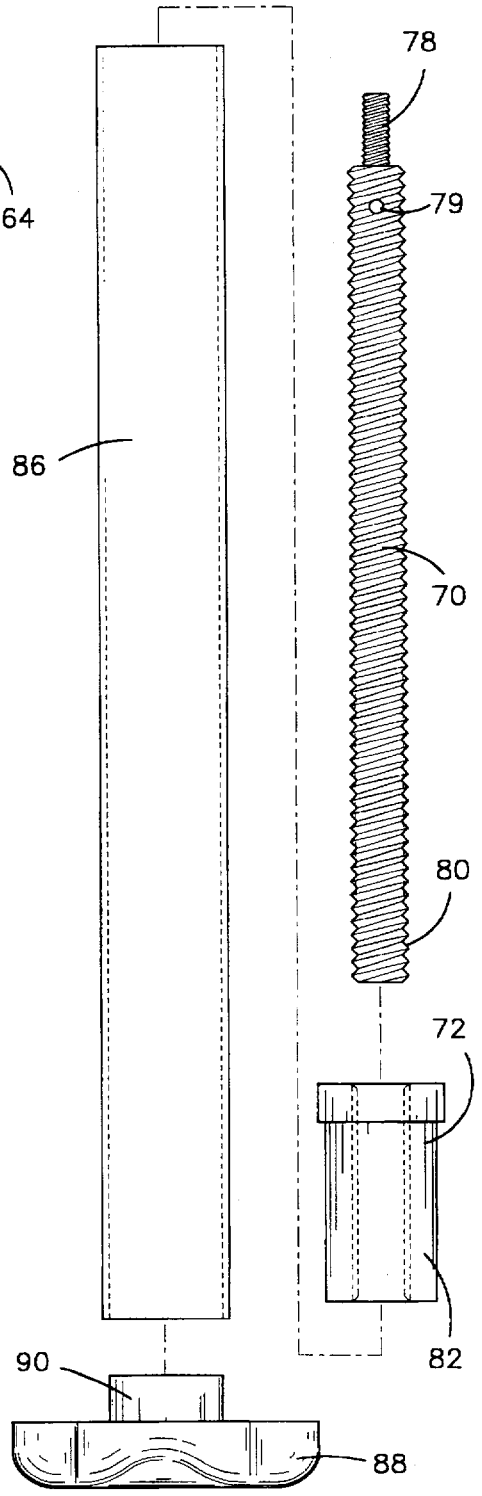
FIG. 5 is an exploded front view of the conversion kit in accordance with the present invention.

An important feature of the invention resides in the fact that plunge routers that have been sold in the past and are in use in the field can be modified for router table installation. Components usable for converting the existing routers may be provided in kit form. Components constituting such a kit are illustrated in FIG. 5. The conversion kit comprises the positioner rod 70 having the reduced diameter threaded end 78 and the larger diameter shank threaded to the end 80 and the positioner 72. Although shown in FIG. 5 as separated, the abutment element 82, the hand wheel 88 and axle 90, and the shaft 86 are assembled together as a unit in the conversion kit. The kit also comprises an allen wrench, not shown, or similar element for assisting assembly.

A plunge router is converted to use the precision adjustment mechanism of the present invention by unscrewing the plunge adjusting mechanism stop screw and removing the stop rod. A tapped turret step is aligned with the lip opening and the screw and nut are removed from the step. The positioner 70 is inserted through the second abutment opening and the positioner end 78 is screwed into the selected turret step using the allen wrench to assure the positioner is tightly screwed in. The abutment element 82 is threaded to the opposite positioner end 80 until the abutment element 82 bears on the second abutment element 66 and has shifted the head assembly to a desired position relative to the base.

While a single embodiment of the invention has been illustrated and described in considerable detail, the present invention is not to be considered limited to the precise construction disclosed. Various adoptions, modifications and uses of the invention may occur to those skilled in the arts to which the invention relates. It is the intention to cover all such adaptations, modifications and uses falling within the scope or spirit of the annexed claims.

Having described my invention I claim:

1. A plunge router constructed for free hand use or mounting beneath a work table comprising:

a. a base adapted to be connected to a work table and defining a central opening;

b. a router head assembly comprising a drive motor, a drive shaft, a collet and a housing, said drive shaft projecting from said motor toward said base in alignment with said base opening so that a router bit mounted in said collet can project through said opening for engaging a work piece on the table top;

c. a plunge guide assembly supporting said router head assembly for movement toward and away from said base;

d. said router head assembly biased toward a default position spaced away from said base a maximum extent along said plunge guide assembly;

e. a retracted position adjusting mechanism coacting between said base and said head assembly for blocking movement of said head assembly to said first default position from a second, adjusted retracted position, said retracted position adjusting mechanism comprising a threaded force transmitting member fixed to said base and projecting toward said head assembly, an abutment element projecting from said head assembly transverse to the direction of extent of said threaded member and an adjustment member threaded to said force transmitting member and engagable with said abutment element to adjustably change said head assembly second retracted position;

f. said head assembly further comprising a second head assembly abutment element; and, g. a precision adjustment mechanism for moving said head assembly a precise distance from said second position to precisely position a router bit relative to said base opening, said adjustment mechanism comprising a first positioner fixed to said base and extending to said second abutment element, a second positioner engaging said second abutment element and said first positioner and a drive transmission coupling said first and second positioners, said drive transmission operative to shift said second positioner along said first positioner to change the distance between said base and said second abutment element, said second positioner comprising a manually actuatable structure disposed remote from said second abutment element, said manually actuatable structure operating said drive transmission to incrementally shift said head assembly for precisely positioning a router bit.

2. The plunge router claimed in claim 1 wherein said drive mechanism comprises threads formed on one of said positioners and a thread engaging structure on said other positioner.

3. The plunge router claimed in claim 2 wherein said second positioner comprises an abutment element for engaging said second head assembly abutment element, and said thread engaging structure is formed on said second positioner abutment element.

4. The plunge router claimed in claim 3 wherein said manually actuatable structure comprises a handle and said second positioner further comprises a linkage extending between said handle and said tapped abutment element.

5. The plunge router claimed in claim 4 wherein said linkage comprises a tubular shaft fixed to said handle and said tapped abutment element.

6. The plunge router claimed in claim 5 wherein said first positioner comprises a rod supporting said threaded section, said rod extending through said tapped abutment element and into said tubular shaft.

7. The plunge router claimed in claim 1 wherein said base comprises a turret member aligned with said second abutment and said first positioner comprises a rod fixed to said turret member.

8. The plunge router claimed in claim 7 wherein said rod defines a threaded section screwed into said turret member.

9. The plunge router claimed in claim 8 wherein said second abutment element comprises a lip projecting from said head assembly and defining a clearance opening through which said rod extends, said rod defining a second threaded section having a diametrical extent smaller than the diametrical extent of said clearance opening.

10. A kit for use with a plunge router having a base, a head assembly, a plunge guide member for guiding head assembly movement forwardly toward said base and rearwardly away from said base, a rearward travel limiting mechanism and a forward travel limiting mechanism, the kit effective to convert the forward plunge travel limiting mechanism to a manually actuatable precision router bit positioner and comprising:

a first positioner having connecting structure at one end region for securing the end region to a router base, a second positioner having a first end region for engaging the head assembly and said first positioner and a drive transmission for coupling said first and second positioners so that said second positioner is adjustably movable along said first positioner when said positioners are assembled, said second positioner comprising a manually actuatable structure disposed remote from said first end region.

11. The kit claimed in claim 10, said kit further comprising an allen wrench and an opening defined by said first positioner for receiving said allen wrench.

12. A plunge router constructed for free hand use or mounting beneath a work table comprising:

a. a base adapted to be connected to a work table and defining a central opening;

b. a router head assembly comprising a drive motor, a drive shaft, a collet and a housing, said drive shaft projecting from said motor toward said base in alignment with said base opening so that a router bit mounted in said collet can project through said opening for engaging a work piece on the table top;

c. a plunge guide assembly supporting said router head assembly for movement toward and away from said base;

d. said router head assembly biased toward a default position spaced away from said base a maximum extent along said plunge guide assembly;

e. said head assembly further comprising a head assembly abutment element;

f. a precision adjustment mechanism for moving said head assembly a precise distance from said default position to precisely position a router bit relative to said base opening, said adjustment mechanism comprising a first positioner fixed to said base and extending to said abutment element, a second positioner engaging said abutment element and said first positioner and a drive transmission coupling said first and second positioners, said drive transmission operative to shift said second positioner along said first positioner to change the distance between said base and said abutment element, said second positioner comprising a manually actuatable structure disposed remote from said abutment element, said manually actuatable structure operating said drive transmission to incrementally shift said head assembly for precisely positioning a router bit; and g. said base further comprising a turret member aligned with said abutment element and said first positioner further comprising a rod fixed to said turret member.

13. The plunge router claimed in claim 12 wherein said rod defines a threaded section screwed into said turret member.

14. The plunge router claimed in claim 13 wherein said abutment element comprises a lip projecting from said head assembly and defining a clearance opening through which said rod extends, said rod defining a second threaded section having a diametrical extent smaller than the diametrical extent of said clearance opening.

* * * * *